US006860313B2

(12) United States Patent
Greissing et al.

(10) Patent No.: US 6,860,313 B2
(45) Date of Patent: Mar. 1, 2005

(54) METHOD AND DEVICE FOR THE PREPARATION OF FOUNDRY SAND

(75) Inventors: Uwe Greissing, Hardheim-Bretzingen (DE); Dieter Adelmann, Kulsheim (DE); Paul Eirich, Hardheim (DE); Herbert Durr, Buchen-Hainstadt (DE); Winfried Diem, Mannheim (DE)

(73) Assignee: Maschinenfabrik Gustav Eirich GmbH & Co. KG, Hardheim (DE)

( * ) Notice: Subject to any disclaimer, the term of this patent is extended or adjusted under 35 U.S.C. 154(b) by 0 days.

(21) Appl. No.: 10/311,991

(22) PCT Filed: Jun. 16, 2001

(86) PCT No.: PCT/DE01/02259

§ 371 (c)(1),
(2), (4) Date: Jun. 2, 2003

(87) PCT Pub. No.: WO01/98001

PCT Pub. Date: Dec. 27, 2001

(65) Prior Publication Data

US 2004/0020623 A1 Feb. 5, 2004

(30) Foreign Application Priority Data

Jun. 23, 2000 (DE) ..... 100 30 675

(51) Int. Cl.[7] ..... B22C 5/18

(52) U.S. Cl. ..... 164/5; 164/412; 366/7; 366/139; 366/6; 366/10

(58) Field of Search ..... 164/5, 412; 366/7, 366/139, 6, 10

(56) References Cited

U.S. PATENT DOCUMENTS

| | | | | | |
|---|---|---|---|---|---|
| 5,588,471 | A | * | 12/1996 | Lowe | 141/83 |
| 5,915,833 | A | * | 6/1999 | Kruse | 366/7 |
| 6,030,111 | A | * | 2/2000 | Tokuyoshi et al. | 366/2 |
| 6,402,361 | B1 | * | 6/2002 | Reinemuth | 366/136 |

FOREIGN PATENT DOCUMENTS

| | | |
|---|---|---|
| GB | 2 066 683 | 7/1981 |
| WO | WO 01/21341 A1 | 3/2001 |

* cited by examiner

*Primary Examiner*—Kiley S. Stoner
*Assistant Examiner*—I.-H. Lin
(74) *Attorney, Agent, or Firm*—Dinsmore & Shohl LLP

(57) ABSTRACT

A device for preparing moulding sand. The device includes a mixer configured to operate under at least a partial vacuum and at least one feeder to introduce components to be mixed. An inlet in the mixer is of sufficient size to allow rapid introduction of the components into the mixer from the feeder. The combination of large inlet opening and a pressure differential between the mixer and the feeder significantly reduces the time required to fill the mixer. In addition, the presence of the pressure differential made possible by the vacuum in the mixer reduces the likelihood that airborne contaminants resident in the mixer will migrate outside the mixer. Optional moveable conveyor chutes minimize contact of airborne contaminants with adjacent equipment, while optional mixing tools facilitate the introduction of powdered additives into the mixer.

33 Claims, 7 Drawing Sheets

METHOD AND DEVICE FOR THE PREPARATION OF FOUNDRY SAND

CROSS-REFERENCE TO RELATED APPLICATION

This application is a 371 of PCT/DE01/02259 filed on Jun. 16, 2001.

BACKGROUND OF THE INVENTION

The present invention relates to a method and a device for the preparation of mould sand using a mixing process in a mixer, wherein the preparation takes place at least partially under vacuum.

The preparation of sand for the manufacture of moulds is intended to produce the correct mixing ratio of grain sizes and of proportions of quartz sand, binding agent, coal dust, optionally other additives as well as recycled and new sand, to homogenise the mixture and, in this context, to coat the grains with the binding agent to a large extent, to adjust the correct moisture content, to adjust the correct temperature of the mould sand and finally to convey the ready-prepared sand to the places of use.

Recycled sand generally has an increased temperature, for example, of between 100° C. and 140° C. Because sand temperatures above approximately 50° C. can present considerable problems to the moulding equipment, and at excessively high temperatures, uncontrollable evaporation losses over the distance between the mixer and the moulding equipment can lead to fluctuations in moisture in the ready sand, the sand must be cooled in this case. Conveyor belt coolers, through which the sand passes continuously as a result of vibrating or agitating movements of a screen mesh, are mostly used for this purpose.

An alternative cooling method has been proposed in DE 295 24 03 C2. This cooling method provides the concurrent preparation and cooling of clay-bound foundry moulding sands in a vacuum mixer. In this context, the individual components are initially placed into the mixer. After a short prehomogenizing process, the temperature and moisture of the mixture are measured and the necessary quantity of water is added. Finally, during the preparation process, the pressure in the mixture is gradually reduced. As soon as the pressure corresponds to the vapour pressure curve of water, the water in the sand begins to boil and removes the necessary evaporation heat from the sand. As a result, an extremely effective cooling method is achieved in an economical manner. According to the disclosure of DE 199 45 569, alongside the cooling effect on the mould sand, the described cooling of mould sand under vacuum also leads to an increase in quality of the mould sand prepared. Accordingly, DE 199 45 569 suggests preparation under vacuum even for recycled sand which has already been cooled.

It has been shown that the best mould sand quality can be achieved with the assistance of vacuum preparation. However, the known stages of the method and the devices and/or peripheral equipment used and their method of operation are only suitable to a limited extent or not at all for use in a fully automated foundry moulding plant. According to experience, error-free and above all economically optimized operation is not possible with the known method.

This is because, among other factors, the filling and emptying of the mixer is very time-consuming. For the ventilation of the mixer, a mixer cover is provided, in all known versions, which, in the closed condition, must be vacuum-tight to allow vacuum operation, and which is opened for the purpose of charging the mixer. In this context, the cover is generally connected to the mixer in a rotatable manner by means of a rotating axis. The cover can be designed in such a manner that it is rotated outwards or inwards in order to open the container. If it is rotated inwards, the closing mechanism must press the cover outwards against the sealing surface of the mixer with considerable force during vacuum operation. In order to manufacture the closing mechanism in an economical manner, the mixer cover must therefore be very small, because only a small force need then be applied by the closing mechanism.

If the cover is opened outwards, the closing mechanism can be designed to be weaker and can therefore be manufactured more economical ly, because the necessary pressing force can be generated by the pressure difference between the mixing container and the surroundings alone. However, with this version, the design must take into consideration that sufficient rotational clearance remains above the cover so that the cover can be opened without it coming into contact with any objects. Accordingly, dosage funnels or dosage devices must be attached at an appropriate distance above the mixer opening. This distance necessarily increases in proportion with the size of cover. However, when filling the mixer, it is important to ensure that the sealing surface of the charging opening remains as a free from contamination as possible, in order to guarantee a vacuum-tight closability. However, the probability of contamination of the sealing surface increases considerably as the distance between the dosage funnel and filling opening and/or the dropping height of the substance to be charged increases. For this reason, it is currently assumed, that a generic mixer cannot be manufactured economically with a large charging opening. Accordingly, the known mixers all possess only a relatively small opening in the pressure casing of the mixer, and, in the case of the equipment known so far, the mixture is added only in a very fine flow. This results in a very long charging time and therefore also a very low plant performance. If the mixer is loaded too quickly, an excess air pressure rapidly builds up as a result of compression of the air in the mixer. This excess pressure generally leads to the emission from the mixer of dust-like components of the mixture, which can, for example, also be deposited on very sensitive machine components, such as cogwheels and gaskets. This means that the plant must be cleaned more frequently which, once again, is associated with higher costs and undesired interruptions of operation. For this reason, it has generally been considered that, on the one hand, the charging rate cannot be further increased, because larger input openings cannot be realized in an economical manner. And, on the other hand, it has been considered that a larger charging rate will lead to the disadvantages described and must therefore be avoided.

SUMMARY OF THE INVENTION

The object of the present invention is therefore to provide a method and a device for preparation of mould sand, which can be used economically without errors, and provides mould sands of uniform temperature and uniformly high quality in an economical manner and which, in comparison with the known mixers, has an increased charging rate.

With regard to the method, this object is achieved by the material to be charged being added at least at times in a volume flow of at least 100–800 l/s through an opening with a diameter of at least 150 mm, preferably at least 300 mm, and particularly preferably at least 500 mm.

In this context, the pressure difference between the ambient pressure and the pressure in the mixing chamber of the mixer is preferably used either as the exclusive or predominant drive for at least one feeder process for water or for a mixture component or for accelerating the feeder process. According to the invention, therefore, the dosage devices and charging devices are coupled with the mixing unit in terms of the design and method. As a result, the vacuum prevailing in the mixer can be used; for example, to accelerate the charging processes, and even during the charging phase, to improve the distribution of the additives and the fluids to be added. In particular in combination with a large charging opening, the consistent use of pressure difference can achieve a significant reduction in charging time. Moreover, this method causes no additional costs, because the evacuation device necessary for the preparation method is already present.

Particularly preferred is a method in which at least a portion of the quality-determining mixture components is fed into the mixer during the charging and/or mixing process. The quality-determining mixture components are the additives already mentioned, such as, for example, bentonite, coal dust, etc., which are added to the recycled sand, in order to adjust the quality of the prepared mould sand. The vacuum pressure in the mixer, which is used to suck in the components to be filled, also effectively prevents the emission of dust-like mixture components from the mixer and their being deposited, for example, on sensitive machine parts.

A particularly expedient version of the method according to the invention additionally provides that the individual mixture components are introduced into the mixer one after another according to a predetermined sequence. However, for special cases of application, it may be advantageous if the water is only introduced into the mixer after the other mixture components have been introduced into the mixer essentially concurrently. As a result, after the other mixture components have been introduced, it is possible to determine the residual moisture and temperature of the recycled sand and from this, to calculate the appropriate quantity of water to be added.

In particular, in order to be able to mix the water to be added as well as possible with the mixture, a preferred version of the method provides that at least one portion of the water to be added is introduced directly into the mixture with the assistance of a preferably rotating feeder device. In this context, by rotating is meant rotating relative to the mixer, so that it is irrelevant whether the feeder device rotates or the feeder device remains stationary and the mixer rotates around the stationary feeder device, or whether both the mixer and the feeder device rotate. This direct method of feeding, that is, below the mixture level, can enable a very good mixing of the water with the mixture.

A particularly effective version of the method provides that at least one portion of the water is introduced into the mixture via a feeder device, which is coupled with a mixing tool or even integrated into a mixing tool. This is particularly advantageous if the mixer already provides a mixing tool. Moreover, as a result of this stage of the method, the water can be mixed directly with the filling substance.

It is also particularly expedient if the quality-determining mixture components, such as e.g. bentonite and coal dust, are introduced into the mixer below the filling level of the mixture. This measure also guarantees a very good mixing of the quality-determining mixture components with the mixture in the mixer.

The quality-determining mixture components are preferably introduced centrally and directly inside the vertically and tangentially flowing mixture bed. This further enhances miscibility.

For some cases of application, it may also be advantageous if at least one portion of the quality-determining mixture components is first mixed with air, and this air/solid mixture is then introduced into the mixer, i.e. preferably below the filling level. After preparation of the mould sand, the mixer must necessarily be ventilated again, that is, the pressure difference between the mixing container and the ambient pressure must be equalized. This can be achieved, for example, simply by opening the container cover. However, a method, in which the mixing chamber is ventilated via a feeder which terminates in the mixing chamber below the filling level of the mixture, is particularly preferred. As a result, the mould sand is compressed to a lesser extent. By contrast, if the equalization air is fed in above the sand level, a kind of pressure cushion will be formed on the surface of the sand as a result of the pressure difference prevailing above and below the filling substance, which leads to definite, temporary compression at least of the uppermost layer of sand.

Of course, it is also possible to use the feeder, which is provided for feeding the quality-determining mixture components, for ventilation and/or pressure equalization. With regard to the device, the object mentioned initially is achieved by a device for the preparation of mould sand with a mixer, which has a vacuum chamber or is arranged in a vacuum chamber, which can be closed in an essentially vacuum-tight manner, with devices for feeding the components to be mixed, at least one mixing tool as well as a device for removing the ready mixture, wherein a closable feeder connection for the components to be mixed exists or can be manufactured between the mixing container and the outside, wherein the feeder opening has a cross-sectional area of at least 0.25 $m^2$, preferably at least 0.4 $m^2$ and particularly preferably at least 0.5 $m^2$.

In principle, the feeder opening can have any cross-sectional form, round or rectangular forms being preferred, however.

Feeding preferably takes place through the feeder opening either exclusively through the pressure difference between the ambient pressure and the pressure in the mixing chamber of the mixer, or feeding is at least accelerated by this pressure difference.

Through this at least one closable feeder connection, the pressure difference between the ambient pressure and the pressure in the mixing chamber of the mixer can be exploited as a driving force. If the feeder connection is opened, as a result of the vacuum pressure existing in the mixing chamber, material to be supplied is drawn into the mixing container from the outside. In general, an additional pump is not necessary for this purpose. The feeder therefore requires no additional energy and is, moreover, essentially maintenance-free.

Particularly preferred is a version in which an essentially vacuum-tight, closable filling opening of the mixer can be connected via an essentially vacuum-tight intermediate space to the outlet opening of at least one dosage device which is preferably designed as a dosage weighing device. Recycled sand, for example, can be introduced into the mixer through this opening. For this purpose, the mixer must first be placed under a vacuum. Following this, the filling opening of the mixer is opened, so that the mixing chamber is connected to the essentially vacuum-tight intermediate space. After this, the outlet opening of at least one feeder device is opened so that the charging materials from the feeder device are first conveyed into the intermediate space and then into the mixing chamber. This charging takes place very quickly because the pressure in the mixing chamber of the mixer and in the intermediate space is significantly lower than the pressure in the feeder device. Particularly preferably, the filling opening of the mixer and/or the outlet opening of the feeder device have a cover with lateral cheeks, which, with the assistance of the lateral cheeks, forms a kind of conveyor chute in the opened state. With the assistance of this conveyor chute, the supplied filling materials can be conveyed from the outlet opening of the feeder device at a high flow rate directly into the inlet opening of the mixer. Particularly preferably, the inlet opening of the mixer and also the outlet opening of the feeder device have a cover with lateral cheeks, each of which therefore form a conveyor chute in the opened state.

For particular cases of application, it could be advantageous if a further movable chute component is provided which can be moved independently of one of the covers. For the purpose of feeding in this case, the cover of the inlet opening of the mixer can first be opened, preferably by means of a control device, then the movable chute component can be brought into its functional position and finally the cover of the feeder device can be opened. The three chutes are then preferably arranged in such a manner that they form a passage for the substance to be filled and guarantee a rapid and targeted charging of the mixer with the substance to be filled. The chutes are preferably arranged in such a manner that they project into the openings and thereby prevent the substances to be filled from coming into contact with the edges of the opening. Contact of this kind could, under some circumstances, impair the sealing function of the cover of the inlet opening of the mixer.

A particularly preferred version of the device according to the invention provides that the mixing chamber of the mixer is arranged in a pressurized container and that, inside the pressurized container but outside the mixing chamber, a closable air feeder is provided. The pressurized container is advantageously connected via appropriate seals to the mixing chamber arranged in the pressurized container. These seats necessarily allow the passage of air, but are intended to hold the components of the mixture in the mixing chamber as firmly as possible. It is not desirable for mixture to escape from the mixing chamber into the pressurized container because contamination of the seals and movable drive components and bearings can occur there. If the mixing chamber is then rapidly loaded with the substance to be filled without vacuum, the pressure in the mixing chamber will rise very rapidly. The seals generally used between the mixing chamber and the pressurized container are, however, not capable of sustaining their sealing function under such an abrupt rise in pressure. It can therefore occur that material from the mixing chamber, which then has a higher pressure than the pressurized chamber, enters the pressurized chamber. As a result of the closable air feeder arranged according to the invention inside the pressurized container but outside the mixing chamber, the pressure in the pressurized container outside the mixing chamber can be increased by the air feeder during the charging process, so that the pressure in the pressurized container is higher than pressure in the mixing chamber. In this way, any transfer of material from the mixing chamber into the pressurized chamber is prevented.

Particularly preferred is a version in which a control unit is provided which opens the air feeder when the mixture components are supplied and closes the air feeder when the vacuum container is closed in a vacuum-tight manner. This control unit is preferably automated, so that, depending on the stage of the method, it is possible to evacuate the pressurized container and also to allow a build-up of pressure in the pressurized container, in order to counteract any abrupt rise in pressure in the mixing chamber as a result of the feeding of mixture components. It is self-evident that the air feeder described can be used outside the mixing chamber but inside the vacuum chamber even with known mixers. Even if the known mixers do not use the pressure difference between the pressurized chamber and the surroundings as a driving force, and consequently, the abrupt rise in pressure resulting from the charging process is significantly smaller, a transfer of material from the mixing chamber into the pressurized chamber will be prevented even with known mixing containers.

A further particularly preferred version of the present invention provides that a feeder device for water is arranged in such a manner that the water is supplied through or along a preferably eccentrically arranged mixing tool with mixing paddles and fed into the mixture essentially in the region of the ends of the mixing paddles. Also in this case, according to the invention, the pressure difference between the mixing chamber and the outside environment is exploited. If water is to be fed into the mixture, a valve merely has to be opened. As a result of the vacuum pressure prevailing in the mixing chamber, the water is sucked through the feeder device directly into the mixture. The arrangement of the feeder device along a mixing tool has the advantage that the water can be fed directly into the mixture at different positions. In this context, the fluid outlet openings in the water feeder device are preferably arranged at different depths below the level of the mixture. Adequate mixing can therefore be achieved extremely quickly.

Particularly preferably, the feeder device for water has a dosage weighing device, the dosage weighing device and mixer being connected by a preferably at least partially resilient pipe, which can be closed by a valve, the valve being preferably arranged on the cover of the mixer.

The so-called quality-determining mixture components are preferably fed with the assistance of a feeder lance, if possible below the level of the mixture. In this context, the outlet opening of the feeder lance is, if possible, oriented tangentially to the direction of flow of the mixture and preferably points in the direction of flow. This guarantees that, as a result of the flow of mixture emphasized by the rotation of the mixture, the quality-determining mixture components, which are sucked into the mixing chamber as a result of the vacuum pressure prevailing in the mixing chamber, are drawn along with the mixture in the direction of flow and are rapidly and effectively mixed with the latter.

Further advantages, features and possible applications of the present invention are explained with reference to the following description of preferred versions and the associated figures.

BRIEF DESCRIPTION OF THE DRAWINGS

There are shown in.

DETAILED DESCRIPTION

Figure 1B:
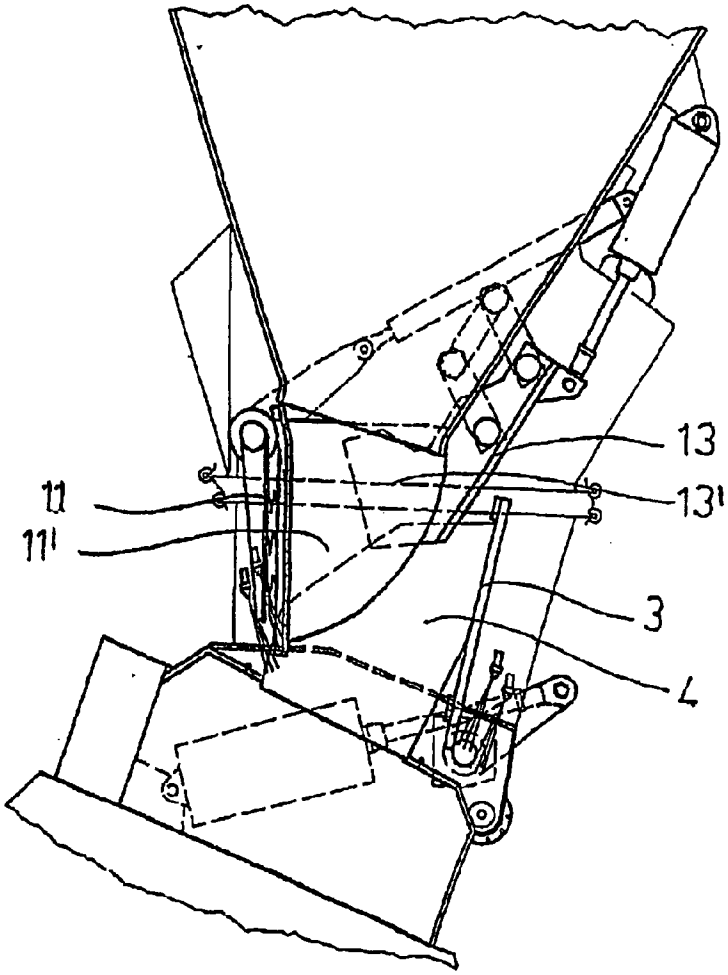
FIGS. 1*a*) and 1*b*) a lateral view of the arrangement of a feeder device and a feeder opening of the mixer in an opened and in a closed position, FIG. 2 a lateral view of a vacuum mixer with a partial sectional view, FIG. 3 a detailed view of FIG. 2, FIGS. 4*a*) and 4*b*) a schematic representation of the connection between a fluid dosage weighing device and mixing container, FIGS. 5*a*) and 5*b*) a lateral view and a top view of the feeder elements for fluids in the mixing chamber, FIG. 6 a schematic representation of the feeder for the quality-determining components and FIG. 7 a lateral view of the arrangement of an alternative feeder device and a feeder opening of the mixer.
Figure 1A:
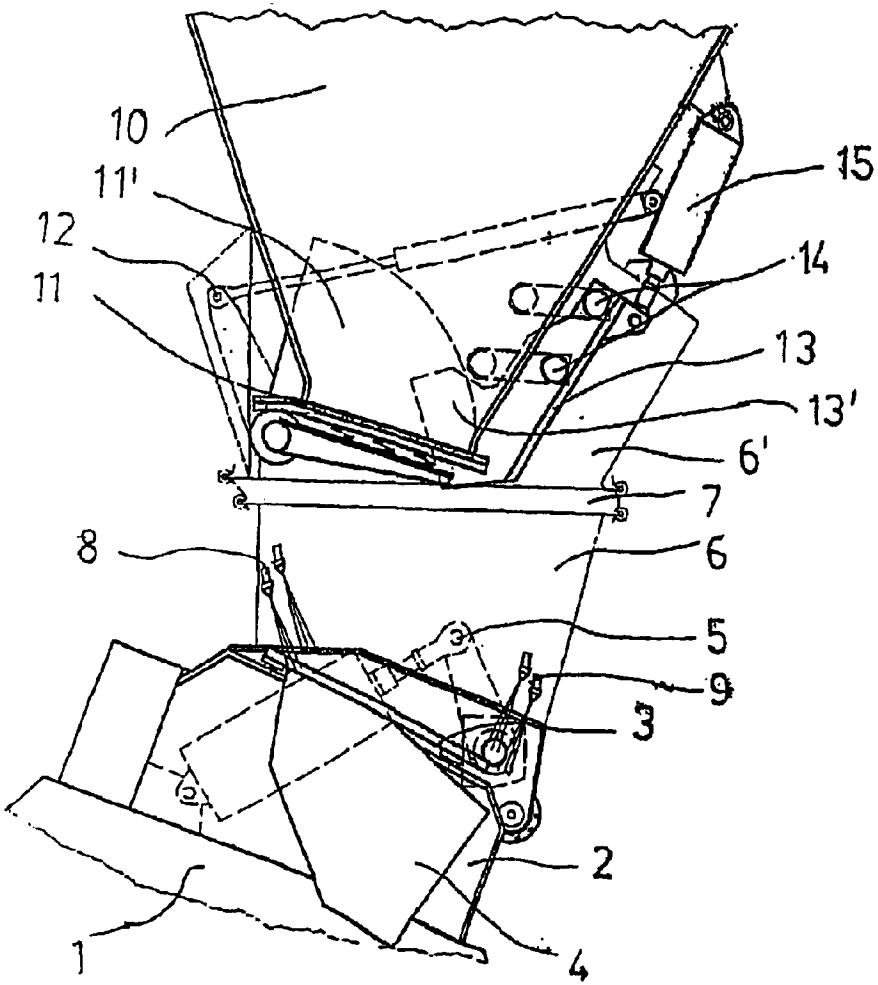

FIGS. 1*a*) and 1*b*) show the outlet region of a solids weighing device 10 and the inlet region of the mixer 1. The solids weighing device 10 is used for determining the quantity of recycled sand to be supplied or optionally also of other mixture components. In FIG. 1*a*), both the mixer 1 and the solids weighing device 10 are closed, while FIG. 1*b*) shows the conveyance position between the mixer 1 and the solids weighing device 10.

An inlet connecting piece 2 is arranged at the upper side of the mixer 1. This inlet connecting piece 2 is sealed in a vacuum-tight manner through the container cover 3 with the assistance of the lever arm 5, which is driven, for example, by a hydraulic cylinder. It can be seen that the container cover 3 provides one lateral cheek 4 at both of its lateral outer edges.

The solids weighing device 10 also has an outlet flap 11, which provides lateral cheeks 11' at both of its lateral outer edges. This flap can be opened or closed via the lever 12.

Moreover, this version has a conveyor chute 13. The conveyor chute 13 also has lateral cheeks 13' at both of its lateral outer edges. The conveyor chute 13 can be moved with the assistance of the parallel guide 14 and the lifting drive 15 into the intermediate space between the solids weighing device 10 and the mixer 1. As a result of the lateral cheeks, the outlet flap 11, filling flap 3 and conveyor chute 13 provide an essentially U-shaped cross-section, the lateral cheeks forming the two arms of the U-shape.

The conveyor chute 13 is arranged in such a manner that, in the extended position, when the outlet cover 11 of the solids weighing device 10 is open, together with the outlet flap 11 and the lateral cheeks 11', 14', it forms a channel with an essentially rectangular cross-section.

This channel is further extended by the open filling cover 8 with its lateral cheeks 4, so that, in the conveying position, the situation shown in FIG. 1*b*) is produced. In this position, the material is guided from the solids weighing device 10 directly into the mixer 1. The conveyor chutes in this arrangement form a kind of channel, so that the edges of the opening are covered and cannot come into contact with the material to be filled.

The entire range of movement of the flaps 3, 11 and of the conveyor chute 13 is surrounded by a housing 6 and/or 6'. In the version shown, the housing is designed in two parts; and the two housing parts 6, 6' are connected to one another via a flexible preferably sealing connection 7. The charging process is as follows. First, the two covers 3, 11 of the mixer 1 and the solids weighing device 10 are closed. If the mixer is to be charged with materials which are located in the solids weighing device 10, the cover 3 of the mixer 1 is first opened. Next, the conveyor chute 13 is moved into the region between the solids weighing device 10 and the mixer 1. This has not hitherto been possible because, in the extended state, the conveyor chute 13 is located within the rotational range of the filling cover 3 of the mixer 1. If the outlet flap 11 of the solids weighing device 10 is then opened, the materials from the solids weighing device will be filled directly and rapidly into the mixing chamber of the mixer 1 via the channel formed by the outlet flap 11, inlet cover 3 and conveyor chute 13. In this manner, the mould sand from the solids weighing device 10 is conveyed into the mixer 1 without significant material loss and without substantial emissions of dust, through a large cross-section and in a short time.

As shown in the diagrams, additionally arranged in the housing 6, 6' are air nozzles 8, 9 which direct an air-flow onto the seal of the inlet cover 3 and the drive mechanism of the inlet cover 3, so that, after each filling process, those places are fanned on which a deposit of sand may have a negative effect, in order to guarantee a secure and sealed closure of the inlet cover 3.

The inlet cover 3 of the mixer 1 according to the invention does not have any particularly complicated design for the sealing elements. Rather, it is simply pressed by the vacuum pressure prevailing in the mixer 1 against the opening of the mixer 1, so that the opening or the cover 3 merely needs to be surrounded by a sealing ring. However, this version of the inlet cover 3 necessarily requires a certain distance between the solids weighing device 10 and the mixer 1, because the cover 3 requires sufficient clearance for rotation. As described, this distance is bridged by the material guiding channel, which is formed from the flaps 3, 11 and the conveyor chute 15 and lateral cheeks 4, 11', 13'. According to the invention, the charging time for a mixer of this kind is reduced from approximately 30–40 seconds, which is entirely standard for mixers available on the market, to less than 10 seconds.

Figure 2:
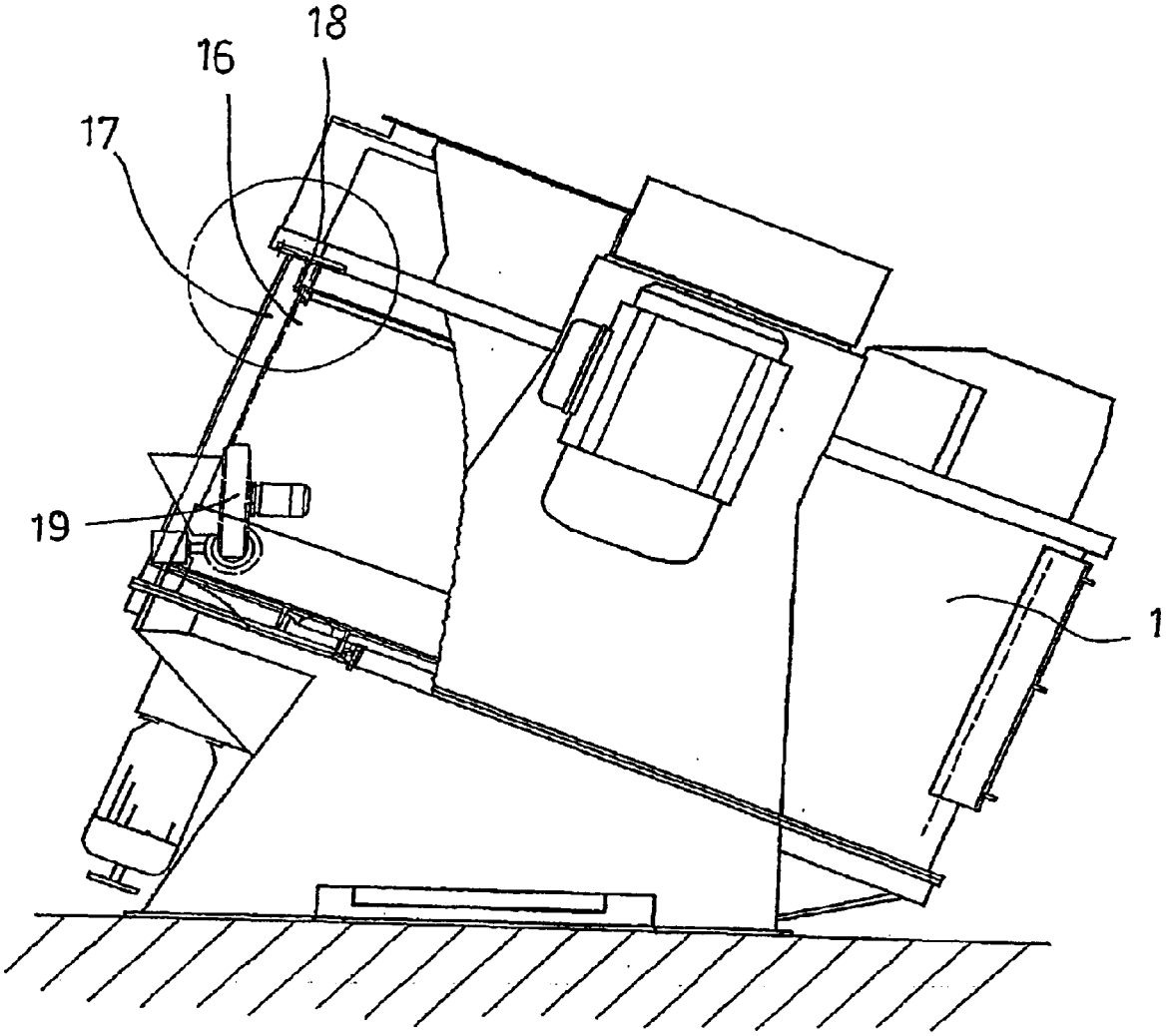
Figure 3:
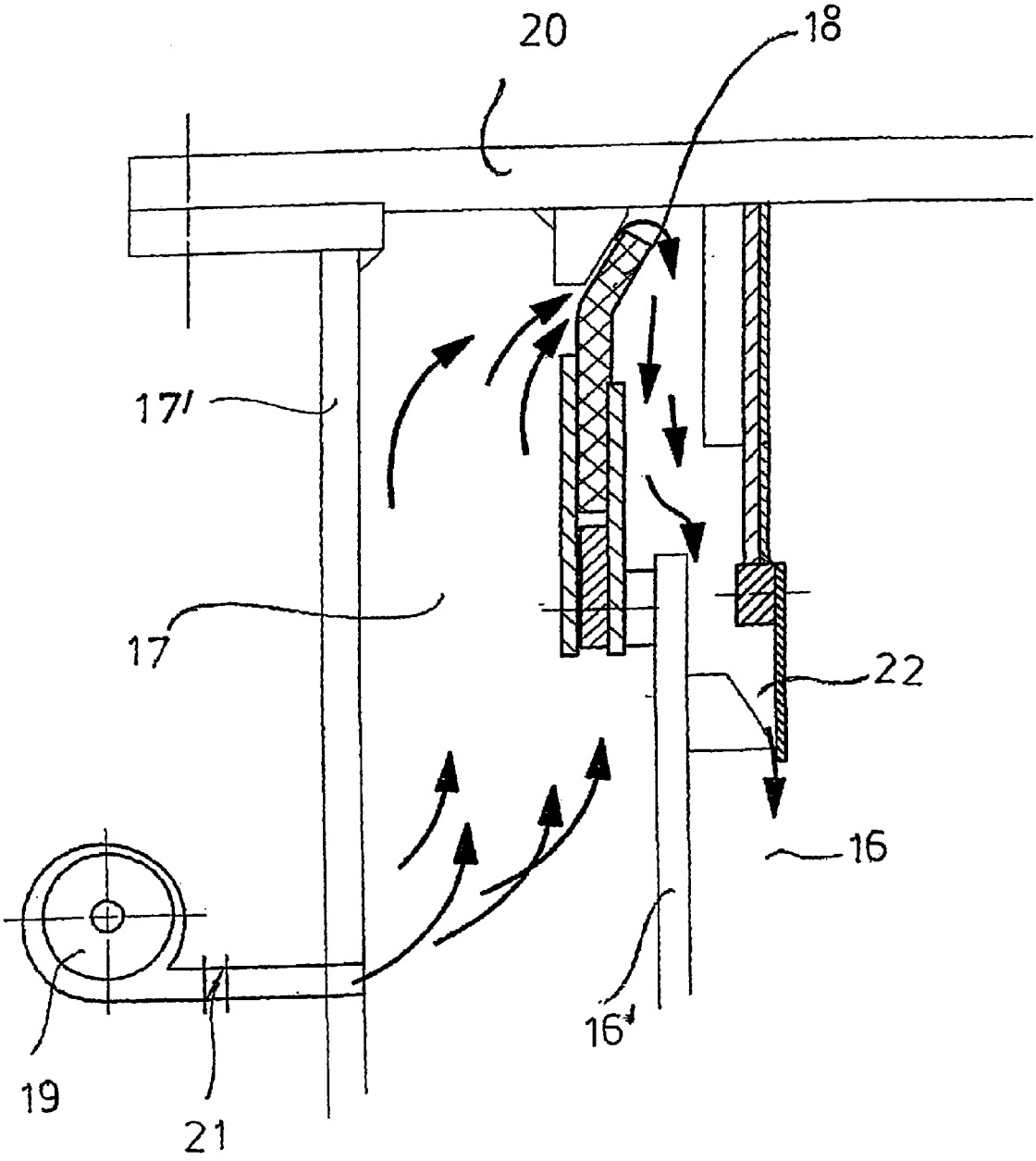

The mixing chamber 16 of a vacuum mixer 1 is normally arranged in a vacuum chamber 17. The basic structure is shown in FIG. 2 with further detail shown in FIG. 3. The vacuum chamber 17 is sealed via flexible seals 18 from the mixing chamber 16. In this context, the seal 18 is used only to prevent the entry of mixture material from the mixing chamber 16 into the vacuum chamber 17. The drive unit for the mixer is generally arranged in the vacuum chamber 17 but outside the mixing chamber 16. For this reason, the reliable function of the seal 18 is extremely important, as otherwise the intermediate space 17 would have to be cleaned frequently, as otherwise the drive unit could be destroyed as a result of solid materials of the mixture. The charging phase, in particular, is a very critical moment for the seal 18. Even with the conventional mixers, an abrupt rise in pressure occurs as a result of the filling process, so that repeated functional failures of the seal 18 occur. This problem is further intensified by the charging process as described with reference to FIGS. 1*a*) and 1*b*). According to the invention, the mixing container is under vacuum at the beginning of the charging process, so that the abrupt rise in pressure in the mixing container is even more pronounced during charging. In order to prevent the entry of dust into the intermediate space 17, a sliding ring seal may, for example, be used. However, since this causes very high costs, a version according to the invention provides a closable air feeder 19. This air feeder, which in FIGS. 2 and 3 is designed as a pressure fan, is capable of increasing the pressure in the intermediate space 17 at the beginning of the charging process. In this context, the rise in pressure in the intermediate chamber 17 should approximately correspond to or even exceed the abrupt rise in pressure in the mixing chamber 16.

FIG. 3 shows structural details of the seal 18. Approximately at the start of the charging process, the valve 21 is opened, so that the pressure fan 19 introduces air into the intermediate space 17 between the pressurized chamber wall 17' and the mixing chamber wall 16'. The air introduced flows in the direction of the arrow through the gap seals 18, 22 into the mixing chamber 16. As a result of this measure, the emission of dust or material from the mixing chamber 16 into the intermediate space 17 is effectively prevented.

It is evident that the air feeder does not necessarily require a pressure fan 19 or a similar device; for some cases of application, it may be adequate if only a closable opening is provided as the air feeder, which is simply opened at the beginning of the charging process, so that the pressure in the vacuum chamber and/or the intermediate space 17 and the mixing chamber 16 rises in an approximately synchronized manner.

At the start of the preparation of the mould sand under vacuum, the air feeder must be switched off again or closed.

Figure 4A:
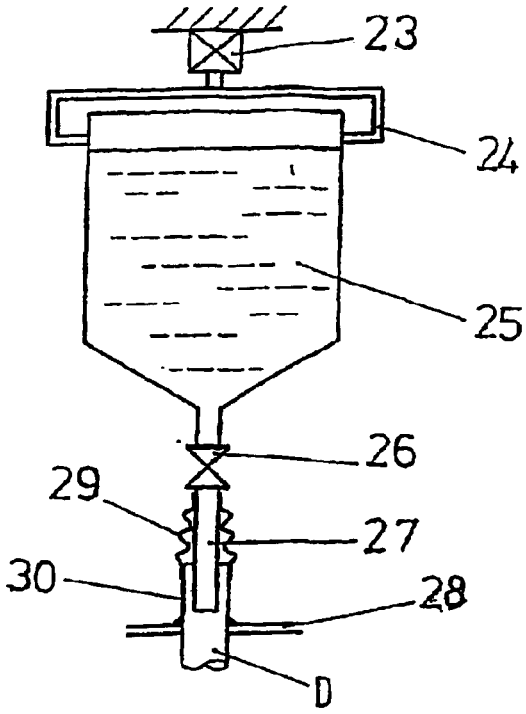

FIGS. 4*a*) and 4*b*) show the charging of the mixer with the necessary quantity of mixing water. Between 0.5 and 4% mixing water are normally added to the mixture. The exact quantity of water to be added is determined by measuring the residual moisture of the recycled sand before placing in the mixer or even in the mixer. The residual moisture of the recycled sand and therefore also the quantity of mixing water to be added depends on the preliminary thermal loading of the recycled sand. Moreover, it must be borne in mind that the vacuum-cooling process also consumes a certain quantity of water because, as described above, it is based upon the removal of evaporation heat, so that an additional quantity of water must be added, which evaporates during the vacuum phase.

FIG. 4*a*) shows a conventional arrangement. A weighing container 25 is shown which is suspended by means of a carrier structure 24 on a weighing cell 23. The weighing cell 23 measures the weight of the weighing container 25 including the carrier structure and content of water. When the valve 26 is opened, the water leaves the weighing container 25 via an outlet pipe 27 and flows into an inlet pipe 30. The inlet pipe 30 is connected rigidly to the pressurized container of the mixer. The inlet pipe 30 and outlet pipe 27 are expediently surrounded by a pressure-resistant but flexible sleeve 29. To allow the water to be added very quickly, water is drawn from the weighing container 25 and the quantity is determined via the weight loss, which is detected by the weighing cell 23.

The pressure difference between the mixing chamber and the surroundings or, in this case, the weighing container 25 can also be used advantageously in the context of the water supply, in order to significantly accelerate the charging process. This is possible in a similar manner to the charging of mould sand described with reference to FIGS. 1 and 2, for example, if the mixing water is supplied while the mixing container is under vacuum. However, with the arrangement shown in FIG. 4*a*), this is only possible subject to other disadvantages.

Figure 4B:
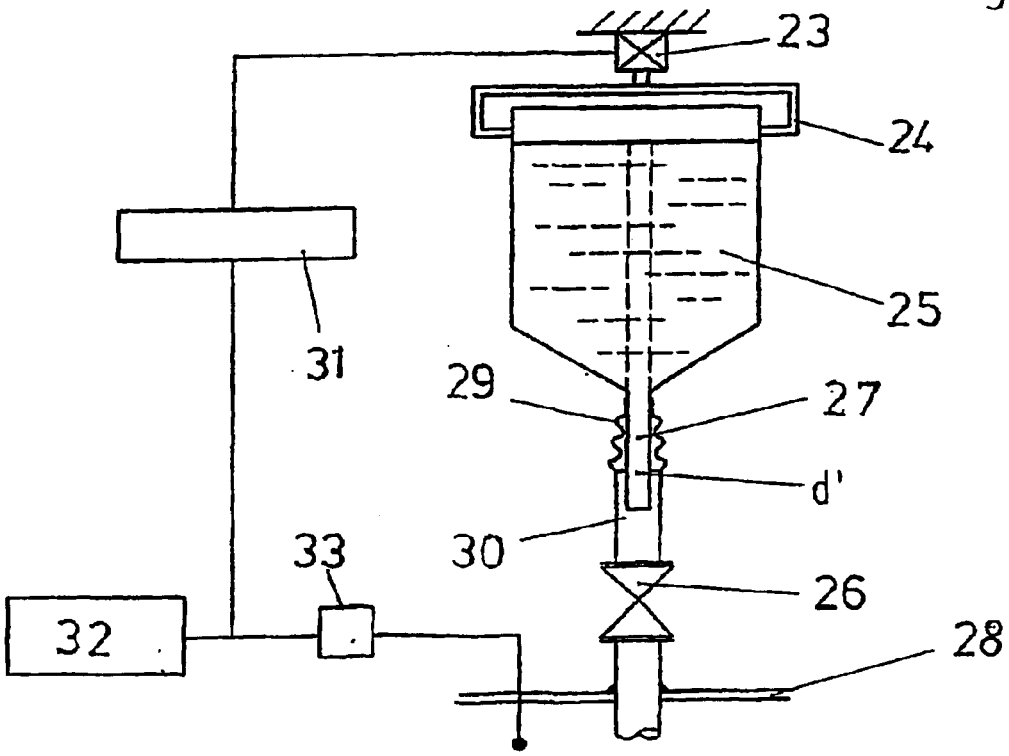

In the case of the arrangement shown in FIG. 4*a*, the vacuum pressure in the mixing container exerts a drawing force on the valve 26 via the inlet pipe 30 with diameter D. This drawing force depends on the momentary pressure in the mixing container and has a disadvantageous effect on the measuring accuracy of the weighing cell 23. Even the filling of the weighing container 25 with water, during a process phase, in which no water is supplied to the mixing chamber, cannot be metered accurately, because the changing pressure in the mixing chamber is also always exerted on the weighing the cell 23. The particular version shown in FIG. 4*b*) provides that the valve 26 is not arranged in the outlet pipe 26 but in and/or on the inlet pipe 30. In this case, the sleeve 29 is necessarily above the valve 26 and not, as in the case of conventional plants, below the valve 26. Moreover, this arrangement has the advantage that the falsifying influence of the mixing chamber pressure on the weighing cell 23, on the one hand, occurs only while the valve is open, and on the other hand, the pressure acts on the weighing cell 23 only via the significantly smaller cross-section d' of the outlet pipe.

As a result of this arrangement, the weighing container 25 can reliably be filled with the desired quantity when the valve 26 is closed. The weighing error while the valve is open can easily be corrected by means of a tare correction.

For particularly accurate dosages, the tare correction can be carried out with the assistance of the dosage computer 31 and the dosage meter 33. The dosage meter 33 registers the current pressure in the mixing chamber and passes this value to the dosage computer 31. The dosage computer 31 calculates the drawing force exerted by the mixing chamber on the weighing cell 23 and corrects the weighing result, so that the mixing water can be metered very accurately.

The duration of filling can be considerably reduced by exploiting the pressure difference between the mixing chamber and the ambient pressure. For example, the cross-section d' of the outlet pipe can be reduced, so that the falsifying influence of the drawing force can be further reduced. As a result, the rate of filling is necessarily increased, but this is more than compensated by the vacuum-filling process.

Introducing the mixing water under vacuum has the additional advantage that the water is immediately finely distributed and spreads in a nebulous manner in the mixing chamber.

Figure 5A:
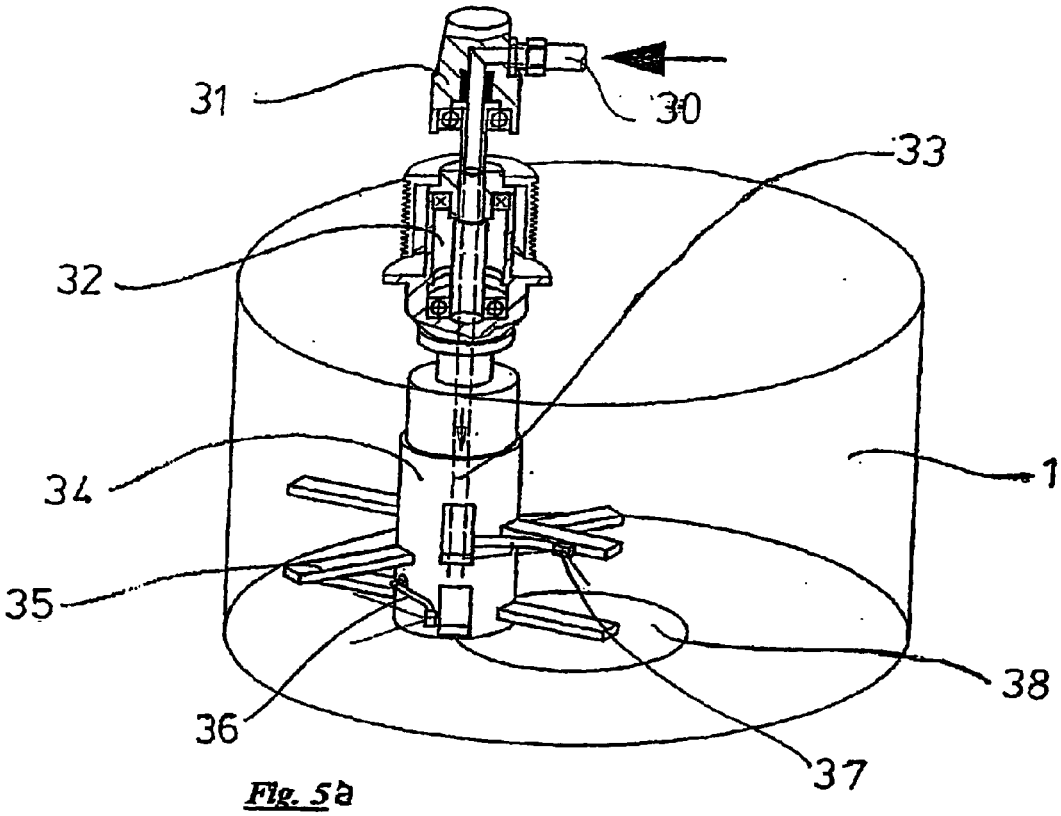
Figure 5B:
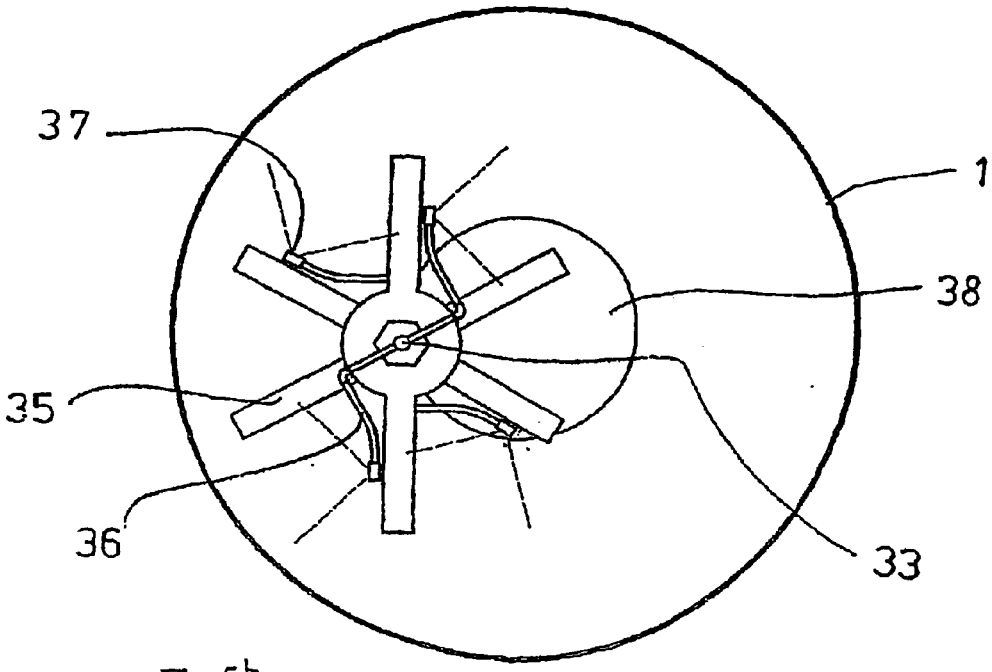

The thorough mixing of the mixing water with the mixture can be further improved and above all accelerated if the mixing water is supplied via a device, as shown in FIGS. 5*a*) and Sb). A mixing shaft 34 with mixing tools 35 is provided in the mixer 1. The mixing shaft 34 is mounted outside the container in a bearing 32. Above the bearing, a rotary connection 31 is connected to the inlet pipe 30. The water flowing from the dosage device, preferably from the; water weighing device described with reference to FIG. 4*b*), in the direction of the arrow, is guided via the rotary connection 31 into the longitudinal bore hole 33 of the mixing shaft 34. The longitudinal borehole 33 is connected at different heights by pipes or hoses 36 to outlet nozzles 37. Subject to the vacuum prevailing in the mixing container, the water is sucked through the supply and distribution system described directly into the mixture, without pumping or other conveying devices being necessary. The method according to the invention even allows the processing of recycled condensation water from a thermal exchange unit of the vacuum cooling process. Condensation water is generally contaminated with fine particles, so that there can be no question of charging this water when using pumps or conventional nozzles, because a pump will wear very rapidly as a result of the fine particles and the nozzles can frequently become clogged. According to the present invention, however, this water can be reused directly without prior costly cleaning processes.

Figure 6:
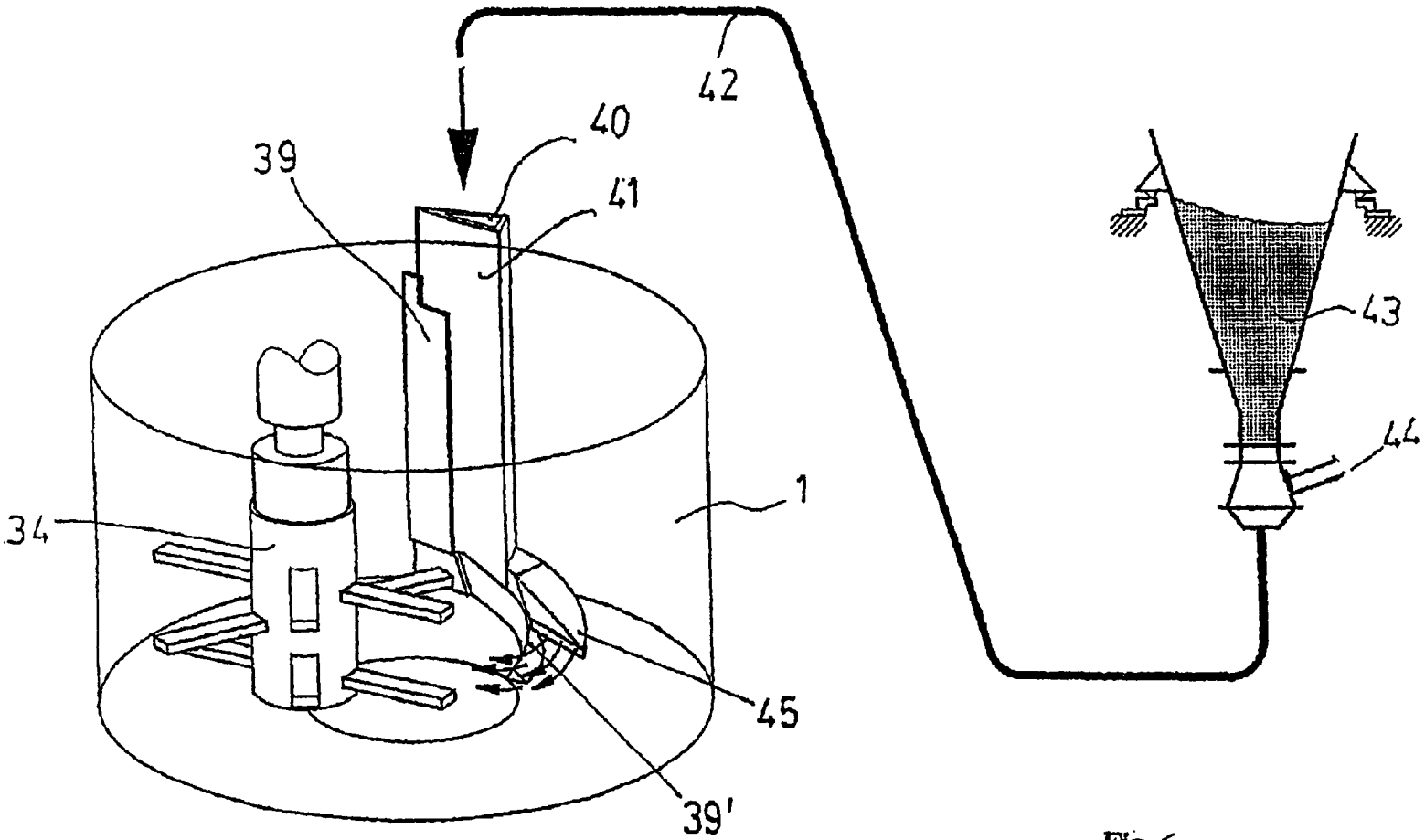

An alternative version of the present invention is shown in FIG. 6. In this case, powdered additives are successfully utilized by exploiting the pressure difference (principle of suction conveyance) between the mixing container and the atmosphere.

These additives, often also referred to as quality-determining mixture components, are normally blown into the mixer under pressure. However, for this purpose, appropriate pressure stores must be provided for the pumping air. In addition to the undesirable additional space requirement, the consumption of expensive compressed air is not to be ignored. Moreover, the vacuum cooling process cannot be implemented while the additives are being supplied, because the supply of additives under pressure is also necessarily associated with an increase in pressure in the mixing container. Furthermore, the charge of compressed air in the mixing chamber can have disadvantageous consequences. In addition to restricting the sealing function of the seal 8, as described in the context of FIGS. 2 and 3, the charge of air can also delay the uniform thorough mixing of the mixture with the mixing water and the additives.

According to the invention, the disadvantages described can be overcome by supplying the powdered additives with the assistance of a preferably stationary mixing tool 39 or its carrier arm 41. The stationary mixing tool 39 is used primarily for guiding the material. With reference to the arrangement shown in FIG. 6, the mixing tool 39 assumes the additional function of cleaning the container wall of mixer 1. The mixer 1 or the mixing chamber rotates in an anticlockwise direction as shown in FIG. 6 from above. The mixing tool "scrapes" along the container wall thereby cleaning any unmixed mixture components from it. The mixing tool guides the mixture from the edge of the container to the middle of the container 1. The mixing tool 39 is attached by means of a carrying arm 41. The carrying arm 41 is designed to be hollow, so that the powdered additives, the quantity of which has been determined with the assistance of the dosage weighing device 43, can be supplied via the feeder 42 into the hollow cavity 40 of the carrier arm. The additives are sucked into the mixing chamber as a result of the pressure difference between the mixing container and the surroundings. The hollow cavity 40 is connected to a feeder nozzle 45, of which the outlet opening is arranged in such a manner that the additives sucked in are guided inwards in as radial a manner as possible. The version shown in FIG. 6 exploits the suction action, which is formed in connection with the mixing tool 39, in order to draw the additives inwards. For this purpose, the mixing tool 39 provides yet another extended region 39' in the vicinity of the base, which is arranged in the direction of flow of the mixture essentially directly in front of the outlet opening of the feeder nozzle 45.

As a result of this sophisticated arrangement and the exploitation according to the invention of the pressure difference, additives can be supplied simply and economically. Moreover, mixing is extremely effective and, above all, rapid.

The hollow tool designed for supplying additives can also advantageously be used for ventilation, that is, for pressure equalization of the mixing container, when the vacuum cooling process is completed. For this purpose, air is simply sucked in through the feeder 44 into the mixing container. Feeding the air directly into the mixture, that is, below the level of the mixture, provides the important advantage that the mixture is not temporarily compressed by the resulting pressure wave, which is not the case with the conventional mixers, and the air can therefore be mixed into the mixture.

Figure 7:
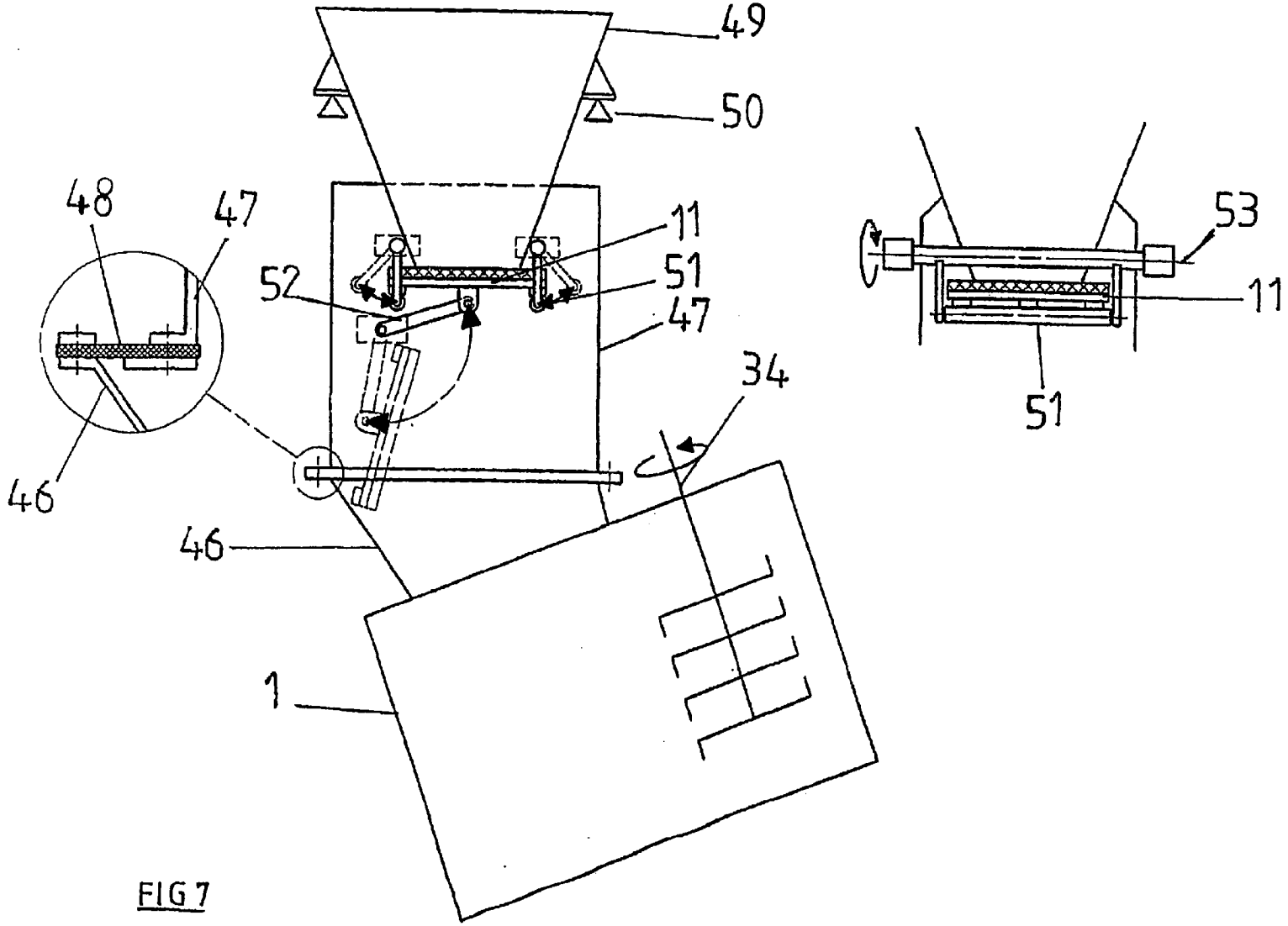

FIG. 7 shows an alternative version of the charging opening of the mixer 1. In this version, the mixer 1 does not have a cover. Only a pressure-resistant, rigid conveying funnel 46, which surrounds the inlet opening, is provided. Above the conveying funnel, a similarly pressure-resistant but movable housing 47 is provided which is connected via a pressure-resistant, flexible connection 48 to the conveying funnel 46. The weighing container 49 is used for the dosage of the mixture to be added. The quantity to be filled can be deduced from the weight of the weighing container 49, which is determined via the force transducer 51. At its lower end, the weighing container 49 provides a pressure-tight closure cap 11, which can be opened and closed via an activation lever 52. Additionally, closure mountings 51 are provided, which serve to hold the closure cap onto the weighing container 49 in a vacuum-tight manner.

This version allows the addition of the mixture under vacuum. The filling procedure is as follows. Initially, the closure cap 11 of the weighing container 49 is closed. The mixing container 1 is evacuated so that vacuum pressure prevails even inside the conveyor funnel 46 and the pressure-resistant housing 47. The mixture is then filled into the weighing container 49, and the quantity to be filled is determined via the pressure transducer 50. When measuring the quantity to be filled, it should be taken into account that the pressure difference between the housing 47 and the interior of the weighing container 49 falsifies the weighing via the force transducer 50. This must be taken into account when calculating the net weight. The weighing container 49 and the housing 47 rigidly connected to the weighing container can readily be displaced in a vertical; direction depending on the filling weight and the pressure difference. This vertical movement is allowed by the flexible connection 48, which is clearly shown in FIG. 7 on the left in the detailed enlargement.

In the next stage, the closure mountings 51, which enclose the closure cap in the manner of a clamp, are rotated outwards around the axis 53, as shown in FIG. 7 in the right-hand detailed view. The closure cap is thus unlocked and can then be opened with the assistance of the activation lever 52. In combination with the large charging opening, the pressure difference between the solids weighing device and the mixing container ensures rapid charging. Furthermore, a cover which includes the associated, necessary drive units can be dispensed with in the case of this version. Moreover, this version requires a lower structural height, because the rotational range for the mixing chamber cover is not necessary, and the closure cap of the solids weighing device can be designed in such a manner that it is immersed in the conveyor funnel or even in the mixing container opening during opening.

It is self-evident that all of the versions described can also be realized with smaller mixing container openings, although this necessarily means that the charging rate will be somewhat lower. Depending on the individual case of application, however, one of the versions described may be advantageous in combination with a smaller charging opening.

What is claimed is:

1. A method for the preparation of mould sand in a mixer, the method comprising:

configuring the mixer to comprise a mixing chamber capable of holding mould sand, quality-determining components, water or a mixture thereof, the mixing chamber defining a cross-sectional opening area of at least 0.25 square meters therein to facilitate the introduction of the mould sand, quality-determining components, water or a mixture thereof;

configuring at least the mixing chamber portion of the mixer to operate under a vacuum;

feeding at least one of mould sand, quality-determining components or water through the opening area at a volume flow rate that at least at times equals or exceeds 100 liters per second; and maintaining a vacuum between the mixing chamber and an ambient environment such that a pressure difference arising therefrom functions as at least a predominant driving force for at least a portion of the time required for said feeding of the mould sand, quality-determining components or water into the mixing chamber.

2. The method of claim 1, wherein the area of said opening is at least 0.4 square meters.

3. The method of claim 1, wherein the area of said opening area is at least 0.5 square meters.

4. The method of claim 1, further comprising introducing at least a portion of the quality-determining components into the mixing chamber during mixing.

5. The method of claim 1, characterized in that at least one of the mould sand, quality-determining components or water are introduced into the mixer in a predetermined sequence.

6. The method of claim 1, wherein the water is only introduced into the mixer after the mould sand or quality-determining components have been introduced into the mixer.

7. The method of claim 1, characterized in that at least a portion of the water is introduced into the mixture with the assistance of a feeder device.

8. The method of claim 7, wherein the feeder device is connected to or integrated with a mixing tool.

9. The method of claim 7, wherein the feeder device is a rotary feeder device.

10. The method of claim 1, characterized in that the quality-determining components are introduced into the mixer below a filling level defined by the mixture.

11. The method of claim 10, characterized in that the quality-determining components are introduced essentially in a cylindrical central region of the mixing chamber the upper limit of which substantially defines the filling level and the lower limit of which is the base of the mixer, where the radius of the cylindrical central region represents a maximum of 90% of the radius of the mixing chamber.

12. The method of claim 10, characterized in that the quality-determining components are introduced into the mixer in such a manner that they provide a motion component in a radial direction towards the centre of the mixer.

13. The method of claim 1, characterized in that at least a portion of the quality-determining components is introduced into the mixer after being mixed with air.

14. The method of claim 1, further comprising venting the mixing chamber by equalizing the pressure via a feeder.

15. The method of claim 14, wherein the feeder terminates in the mixing chamber below the filling level of the mixture.

16. The method of claim 1, further comprising operating at least one seal cooperatively with the mixer to reduce the flow of mould sand, quality-determining components, water or a mixture thereof across a region adjacent the at least one seal.

17. A device for preparing mould sand, the device comprising:

a mixer comprising at least one mixing chamber configured to accept mixture components therein, the mixing chamber configured to operate in a substantially vacuum-tight manner;

a feeder configured to introduce the mixture components into the mixer, the feeder comprising at least one closable connection between the mixing chamber and an ambient environment;

an opening defined between the feeder and the mixer, the opening having a cross-sectional area of at least 0.25 square meters such that the feeding of the mixture components to the mixer is at least partially facilitated by a pressure difference formed by a vacuum between the ambient environment and the mixing chamber during at least a portion of the time required for preparing the mould sand;

at least one mixing tool disposed in the at least one mixing chamber; and a device for removing the mixture components once the mixture components have been mixed.

18. The device of claim 17, wherein the area of said opening is at least 0.4 square meters.

19. The device of claim 17, wherein the area of said opening is at least 0.5 square meters.

20. The device of claim 17, wherein connection between the mixer and feeder is via a substantially vacuum-tight intermediate space.

21. The device of claim 20, further comprising at least one cover, where at least one of the at least one cover includes lateral cheeks and which, in the opened state, forms a conveyor chute between the feeder and the mixer.

22. The device of claim 21, further comprising a movable chute that is independent of the at least one cover.

23. The device of claim 22, further comprising a control device configured to move the at least one cover and the movable chute.

24. The device of claim 20, wherein the feeder device comprises a dosage weighing device.

25. The device of claim 17, characterized in that the mixing chamber is arranged in a pressurized container and that a closable air feeder is provided inside the pressurized container, but outside the mixing chamber.

26. The device of claim 25, characterized in that a control unit is provided which opens the air feeder when mixture components are being supplied and closes the air feeder when the pressurized container is closed in a substantially vacuum-tight manner.

27. The device of claim 17, further comprising a water feeding device arranged to feed the water into the mixing chamber through or along a preferably eccentrically arranged mixing tool with mixing paddles.

28. The device of claim 27, wherein the fluid outlet opening is configured to introduce water at different depths below a fillings level defined by the mixture components.

29. The device of claim 27, wherein the water feeding device defines a fluid outlet opening that is configured to introduce the water into the mixture in the region adjacent the ends of the mixing paddles.

30. The device of claim 17, characterized in that the water feeding device is a water dosage weighing device, the water dosage weighing device and mixer being connected by an at least partially resilient pipe that can be closed by a valve coupled directly on the mixer, the resilient portion of the pipe located between the valve and the water dosage weighing device.

31. The device of claim 17, characterized in that the supply of mixture components is provided below a filling level defined by the mixture components with the assistance of a feeder lance.

32. The device of claim 31, characterized in that an outlet opening of the feeder lance is oriented tangentially to the direction of flow of a mixture formed by the mixture components and preferably points in the direction of flow.

33. The device of claim 17, wherein the mixing chamber further comprises at least one flexible seal coupled thereto, the at least one seal configured to minimize the flow of mixture components thereacross.

* * * * *